US010082365B2

(12) United States Patent
Zerbe

(10) Patent No.: US 10,082,365 B2
(45) Date of Patent: Sep. 25, 2018

(54) PROTECTIVE SCOPE COVER DESIGN

(71) Applicant: Practical Arms Solutions, LLC, New Cambria, KS (US)

(72) Inventor: Jarret Zerbe, Frisco, TX (US)

(73) Assignee: Practical Arms Solutions, LLC, New Cambria, KS (US)

( * ) Notice: Subject to any disclaimer, the term of this patent is extended or adjusted under 35 U.S.C. 154(b) by 15 days.

(21) Appl. No.: 15/659,232

(22) Filed: Jul. 25, 2017

(65) Prior Publication Data

US 2017/0336170 A1 Nov. 23, 2017

Related U.S. Application Data

(63) Continuation of application No. 15/136,284, filed on Apr. 22, 2016, now Pat. No. 9,746,285.

(60) Provisional application No. 62/151,202, filed on Apr. 22, 2015.

(51) Int. Cl.
*F41G 1/38* (2006.01)

(52) U.S. Cl.
CPC ..... *F41G 1/383* (2013.01)

(58) Field of Classification Search
CPC ..... F41G 1/383; F41G 11/00; F41G 11/002; F41G 11/003; F41G 11/004; F41G 11/005; F41G 11/006; F41G 11/007; F41G 11/008
See application file for complete search history.

(56) References Cited

U.S. PATENT DOCUMENTS

| | | | | | |
|---|---|---|---|---|---|
| 2,649,779 | A * | 8/1953 | Hardgrove | F41G 11/001 | 42/127 |
| 2,717,447 | A * | 9/1955 | Leupold | F41G 11/001 | 24/514 |
| 3,642,341 | A * | 2/1972 | Selfried | F41C 33/08 | 356/247 |
| 3,977,113 | A * | 8/1976 | Howell | F41G 1/383 | 42/129 |
| 5,155,915 | A * | 10/1992 | Repa | F41G 1/383 | 42/127 |
| 8,240,076 | B2 * | 8/2012 | Carley | F41G 1/383 | 206/317 |
| 9,470,470 | B2 * | 10/2016 | Pisani | F41A 35/02 | |
| 2014/0026463 | A1 * | 1/2014 | Park | F41G 1/383 | 42/129 |
| 2015/0052796 | A1 * | 2/2015 | Baker | F41C 27/00 | 42/96 |
| 2015/0308786 | A1 * | 10/2015 | Cheng | F41G 11/001 | 42/90 |
| 2016/0341522 | A1 * | 11/2016 | Davis | F41H 5/12 | |

* cited by examiner

*Primary Examiner* — Gabriel J. Klein
(74) *Attorney, Agent, or Firm* — Warn Partners, P.C.

(57) ABSTRACT

A scope protector is provided that includes a front and rear hinged arch for encircling the scope. The hinged arches are connected by a plurality of protector rods. The scope protector can be attached to a gun rail such as a PICATINNY RAIL commonly found on modern firearms.

13 Claims, 5 Drawing Sheets

PROTECTIVE SCOPE COVER DESIGN

CROSS REFERENCE TO RELATED APPLICATIONS

This application is a continuation of U.S. patent application Ser. No. 15/136,284 filed Apr. 22, 2016 which claims the benefit of U.S. Provisional Patent Application No. 62/151,202 filed on Apr. 22, 2015. The disclosures of the above applications are incorporated herein by reference.

FIELD OF THE INVENTION

The field of the present invention is that of protectors for scopes and other gun accessories such as laser aiming modules, night vision devices, reflex sites and tactical lights and other like gun accessories. More particularly the present invention relates to protectors for scopes and other gun accessory devices for rifles and shotguns that are positioned on top of a gun stock or barrel.

BACKGROUND OF THE INVENTION

To increase accuracy in shooting, many guns have a scope or other auxiliary device. Many of these devices are more fragile than the gun and therefore need to be protected against physical damage. Damage can easily occur if the gun is inadvertently dropped or entangled by brush or other vegetation in a forest or jungle environment.

It is desirable to provide a scope protector which in at least one preferred embodiment is easily and readily attachable to a gun. It is desirable to provide a scope protector which in at least one preferred embodiment attachment is so simple that attachment can be accomplished in darkness in a combat environment. It is desirable to provide a scope protector that can be easily modified for a variety of guns. It is desirable to provide a scope protector that can be easily modified for a variety of scopes or other auxiliary devices. It is desirable to provide a scope protector, that when removed from a gun, is a single unitary member.

SUMMARY OF THE INVENTION

To make manifest the above delineated and other desires, a revelation of the present invention is brought forth. In a preferred embodiment, the present invention endows a freedom of a scope protector that includes a front and rear hinged arch for encircling the scope. The hinged arches are connected by a plurality of protector rods. In a preferred embodiment, the scope protector can be attached to a gun rail such as a PICATINNY RAIL commonly found on modern firearms.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
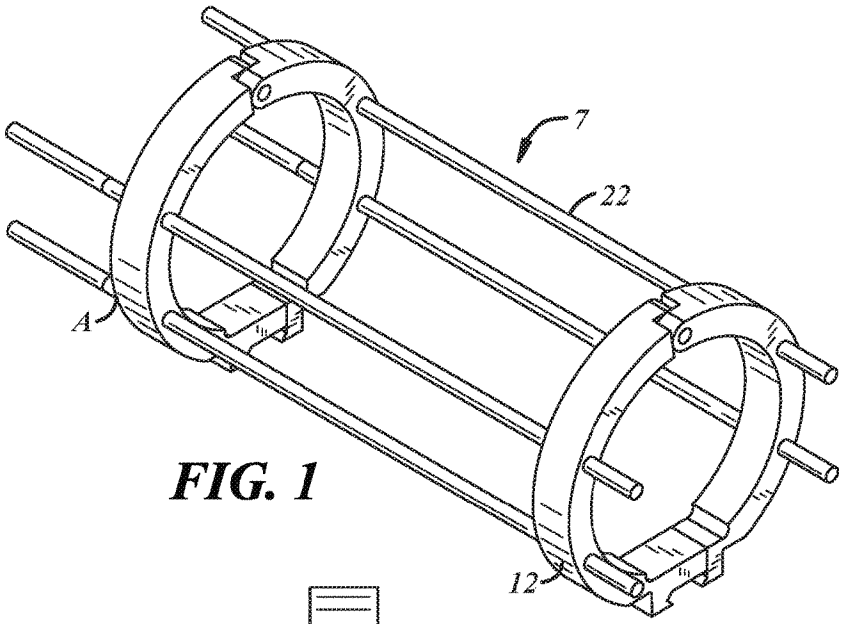
FIG. 1 is a perspective view of a scope protector according to the present invention.
Figure 2:
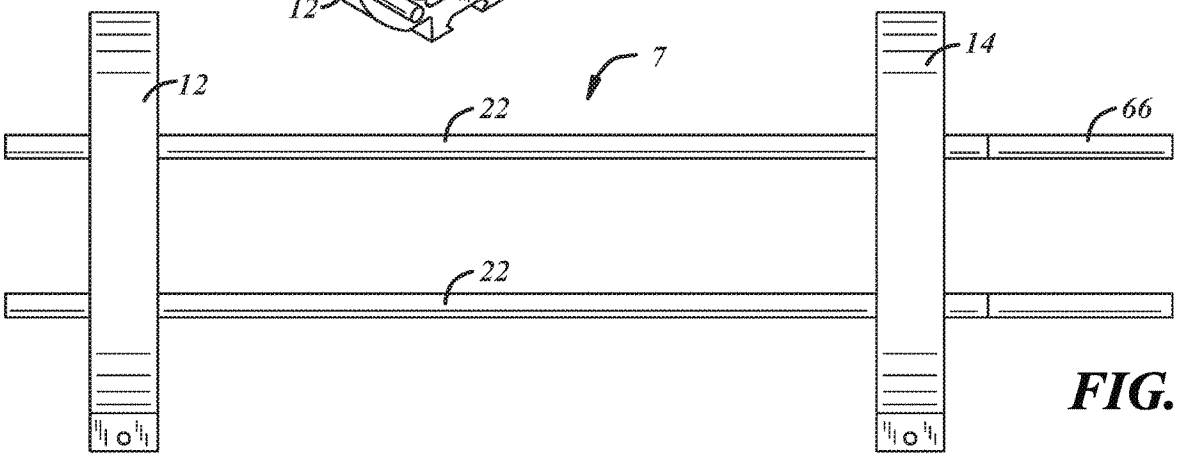
FIG. 2 is a side elevational view of the scope protector shown in FIG. 1.
Figure 3:
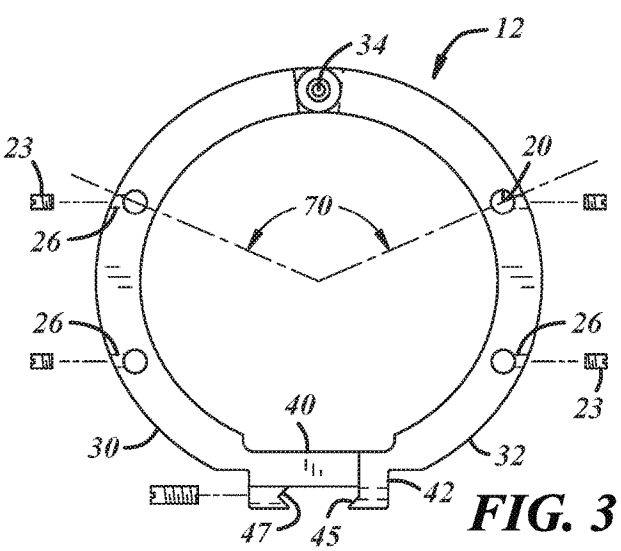
FIG. 3 is a front elevational of a hinged arch of scope protector shown in FIG. 1.
Figure 4:
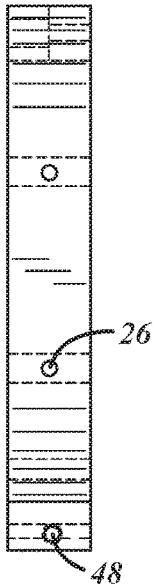
FIG. 4 is a side elevational view of the hinged arch shown in FIG. 3.
Figure 5:
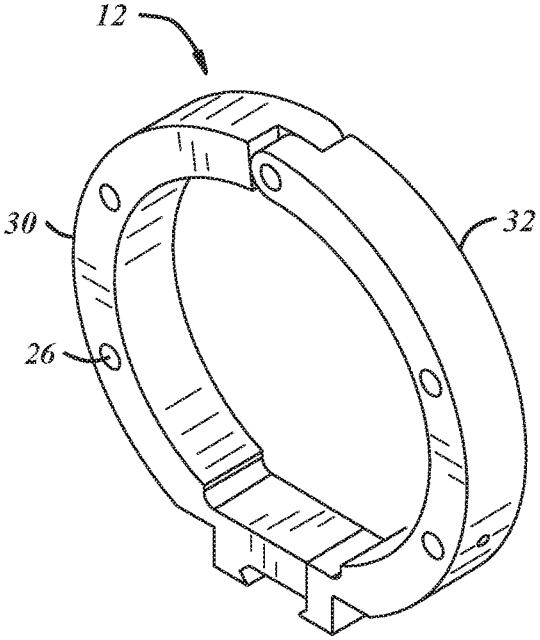
FIG. 5 is a perspective view of the hinged arch shown in FIGS. 3 and 4.
Figure 6:
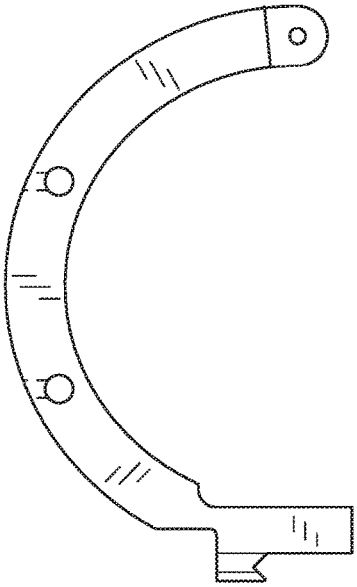
FIG. 6 is a front elevational view of a portion of the hinged arch shown in FIGS. 3 and 4.
Figure 7:
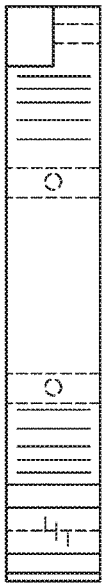
FIG. 7 is a side elevational view of the portion of the hinged arch shown in FIG. 6.
Figure 8:
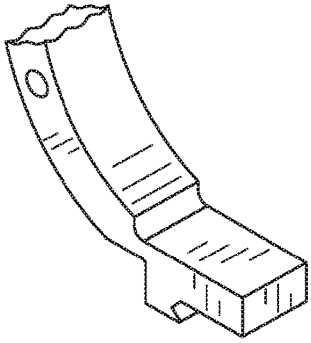
FIG. 8 is a partial perspective view of the hinged arch shown in FIG. 6.
Figure 9:
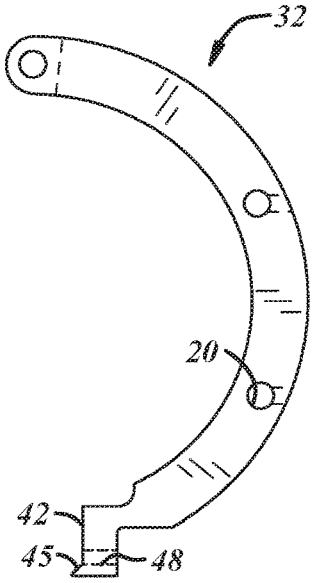
FIG. 9 is a front elevational view of another portion of the hinged arch shown in FIGS. 3 and 4.
Figure 10:
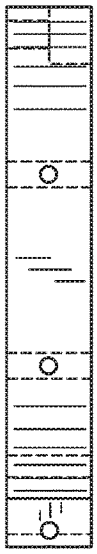
FIG. 10 is a side elevational view of the hinged arch shown in FIG. 9.
Figure 11:
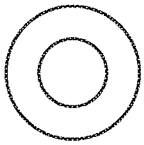
FIG. 11 is a front elevational view of a protector rod shown in FIG. 1.
Figure 12:
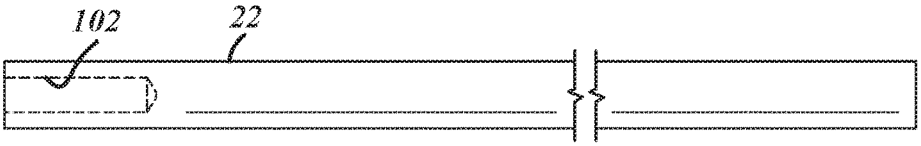
FIG. 12 is a side elevational view of the protector rod shown in FIG. 1.
Figure 13:
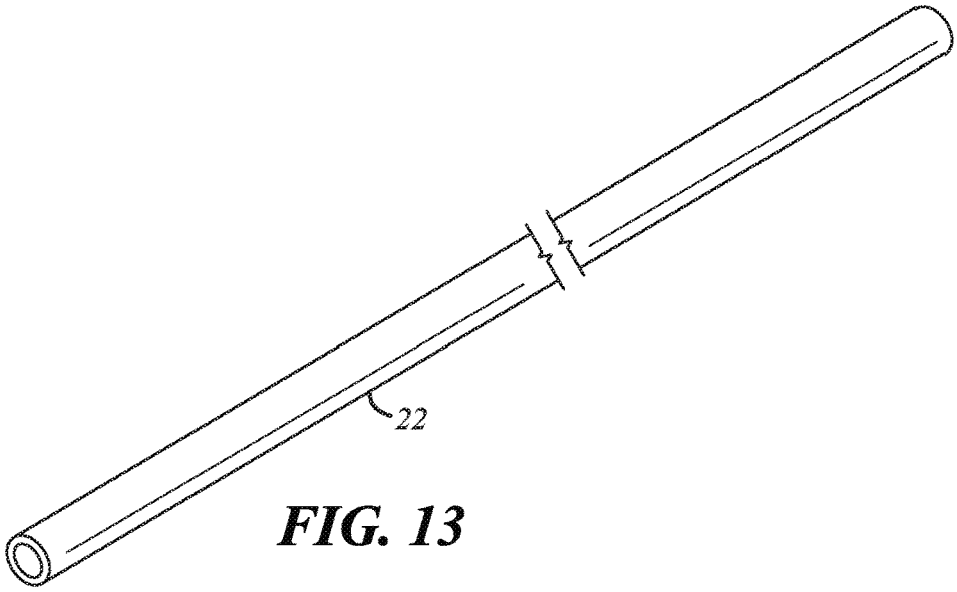
FIG. 13 is a perspective view of the protector rod shown in FIG. 1.
Figure 14:
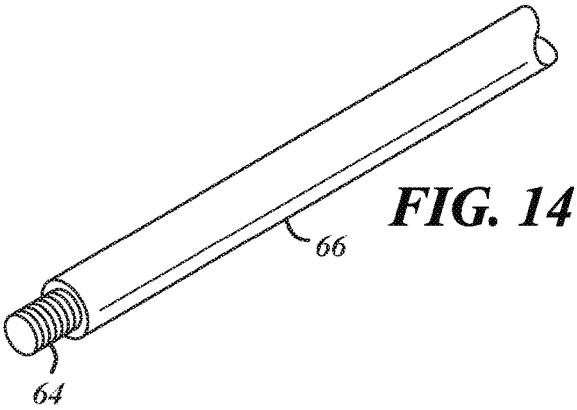
FIG. 14 is a partial perspective view of a protector rod extension.
Figure 16:
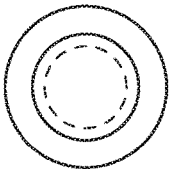
FIG. 16 is a front elevational view of the protector rod extension shown in FIG. 15.
Figure 15:
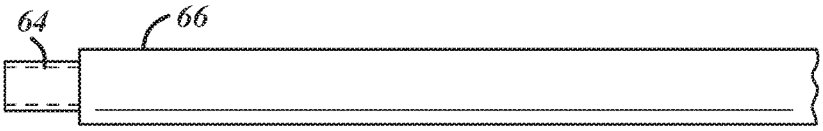
FIG. 15 is a side elevational view of a protector rod extension.

The following description of the preferred embodiment(s) is merely exemplary in nature and is in no way intended to limit the invention, its application, or uses.

Referring to FIGS. 1 through 17, a scope protector 7 for guarding a scope 8 of a gun 10 is provided. The scope protector 7 includes a rear hinged arch 12 and a front hinged arch 14. The hinged arches 12 and 14 are typically identical to each other and are therefore interchangeable. The hinged arch 12 is typically elliptical, almost circular in its cross-sectional shape being slightly greater in its width dimension than in its vertical dimension to allow it to encircle the scope 8.

The hinged arch 12 has 4 cross bores 20 allow for insertion of protector rods 22. The protector rods 22 are affixed to the hinged arches 12, 14 via threaded set screws that are inserted in set screw bores 26. Typically the set screws 23 are drivable by a blade drive or Allen wrench. Set screw bores 26 are drilled to be generally parallel with each other and are horizontal. Since the protector rods 22 are connected with the hinged arches 12, 14 by set screws, the axial length between the hinged arch 12 and 14 can be adjusted for the particular application that the scope protector 7 is being utilized for. A cross-sectional angle 70 between the top protector rods 22 is designed so that there is no less than 90° unobstructed area between the protector rods to allow a gun operator easy access for any fine adjustments needed be made to the scope 8.

The hinged arch is fabricated from arcuate members 30 and 32 and are hingeably connected along their top ends by a hinge pin 34. Arcuate member 30 has a floor piece 40 attached thereto. Floor piece 40 abuts a stud 42 that is connected with arcuate member 32. The stud 42 and floor piece 40 have cam faces 45 and 47 to allow them to be attached to a Picatinny mounting rail 51 of the gun 10. A through bore 48 that extends through the cam faces 45 and 47 allows the hinged arch 12 be fixedly connected with the mounting rail by a set screw. Attachment is relatively easy, which allow for attachment in non-lighted environments. When the scope protector 7 is removed from the gun 10, the scope protector is a single unitary member.

The protector rods 22 along their forward end have a threaded bore 62 to allow a threaded stud 64 of a protector rod extension 66 to be a threadably attach thereto. The hinged arches and protective rods 22 are typically fabricated from aluminum, titanium or other light strong metal or from a fiber reinforced polymeric material.

Figure 18:
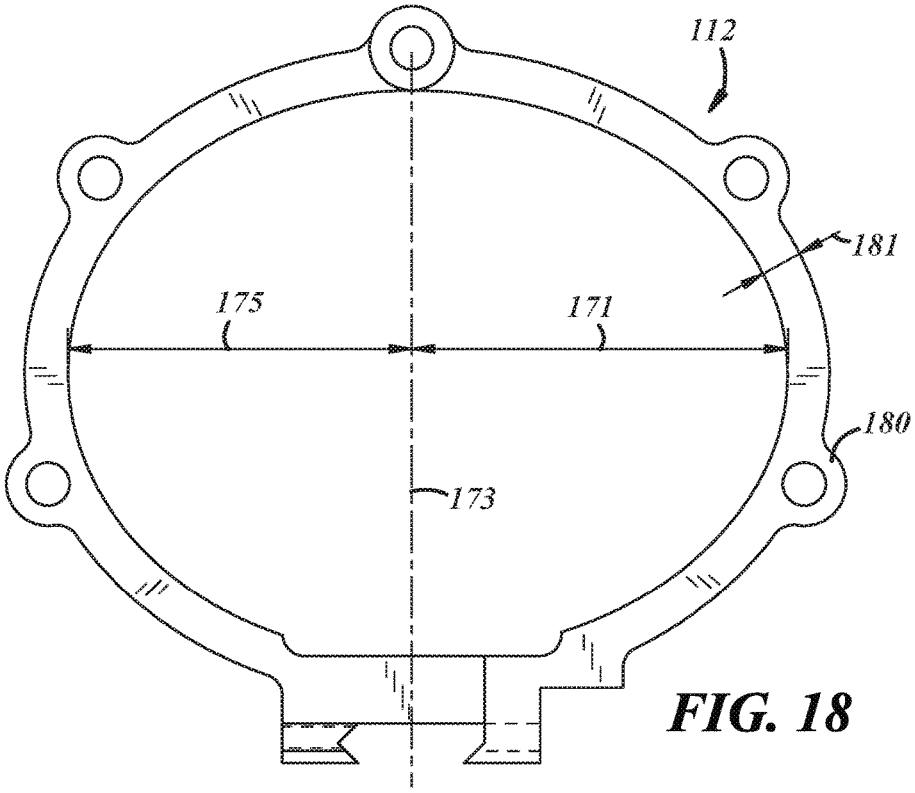
FIG. 18 is an alternate preferred embodiment hinged arch to the hinged arch shown in FIG. 3.
Figure 17:
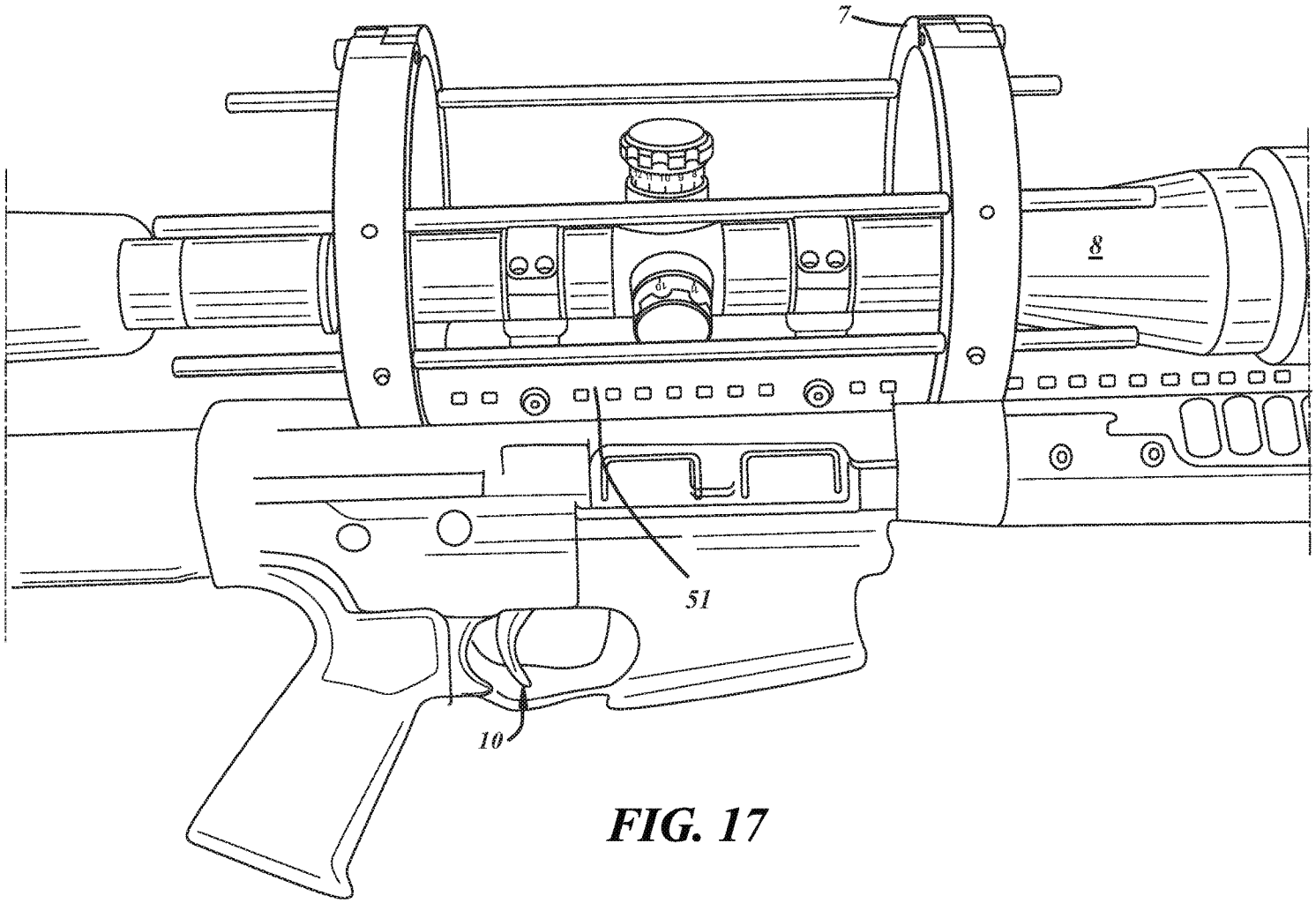
FIG. 17 is a perspective view of the scope protector installed on a semi-automatic rifle.

FIG. 18 provides a hinged arch 112. The hinged arch 112 has a side dimension 171 from a center line 173 that is approximately 9 to 10% larger than side dimension 175. The larger dimension 171 in the arch 112 accommodates additional space for adjustment knobs on the scope. Hinged arch 112 also has flange area 180 around the holes for the protector rods, allowing the hinges' main radial body 181 to have a radial thickness less than that of the reinforcement rod. Centerline 183 vertically intersects the floor piece of the arcuate member and bisects the cam faces in the same manner as a centerline through hinge pin 34 vertically intersects the floor piece 40 in the embodiment shown in FIG. 3.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. A scope protector for guarding a scope mounted to a gun by a structure or structures other than the protector, said protector comprising:

a front hinged arch for encircling the scope;

a rear hinged arch for encircling the scope;

a plurality of protector rods extending between said hinged arches;

and wherein said front and rear hinged arches can be attached to a mounting rail and the axial length between said front and rear hinged arches is adjustable, and wherein said front and rear hinged arches are each fabricated from arcuate members hingeably connected generally along their top ends by a hinge pin, one of said arcuate members having a floor piece attached thereto, the floor piece abutting a stud connected with the opposite arcuate member, the floor piece and stud having cam faces allowing them to be attached to the mounting rail;

and wherein a through bore extends through the cam faces to allow said hinged arches to be fixably connected to the mounting rail by a screw.

2. A scope protector as described in claim 1 wherein the mounting rail is a Picatinny rail.

3. A scope protector as described in claim 1 wherein at least one said hinged arch has a set screw to fix at least one said protector rod to said arch.

4. A scope protector as described in claim 1 wherein a centerline of each hinged arch vertically intersects a respective arcuate member floor piece.

5. A scope protector as described in claim 1 wherein said arches are fabricated from one of a group of materials consisting of aluminum, titanium and fiber reinforced polymeric material.

6. A scope protector as described in claim 1 wherein said protector rods are fabricated from one of a group of materials consisting of aluminum, titanium and fiber reinforced polymeric material.

7. A scope protector as described in claim 1 wherein there are at least four protector rods.

8. A scope protector as described in claim 7 wherein from a cross-sectional view more than 90 degrees is unobstructed by protector rods.

9. A scope protector as described in claim 1 wherein at least one of said protector rods has a threadably connected extension.

10. A scope protector as described in claim 1 wherein said hinged arch has one side larger than the other to accommodate an adjustment knob on the scope.

11. A scope protector for guarding a scope of a gun, said protector comprising:

front and rear elliptical hinged arches for encircling the scope, said hinged arches being hinged at the top and having one side generally nine to ten percent larger from a center line, said hinged arches being fabricated from one of a group of materials consisting of aluminum, titanium and fiber reinforced polymeric material;

and wherein said front and rear hinged arches can be attached to a mounting rail and the axial length between said first and second hinged arches is adjustable, and wherein said front and rear hinged arches are each fabricated from arcuate members hingeably connected generally along their top ends by a hinge pin, one of said arcuate members having a floor piece attached thereto, the floor piece abutting a stud connected with the opposite arcuate member, the floor piece and stud having cam faces allowing them to be attached to the mounting rail;

and wherein a through bore extends through the cam faces to allow said hinged arches to be fixably connected to the mounting rail by a screw;

at least four protector rods extending between said hinged arches, said protector rods being fabricated from one of a group of materials consisting of aluminum, titanium and fiber reinforced polymeric material, said protector rods being connected to said arches by set screws, set in generally parallel horizontal bores, wherein from a cross-sectional view more than 90 degrees is unobstructed by said protector rods.

12. A method of using a scope protector to protect a scope mounted to a gun by a structure or structures other than the scope protector, said method comprising:

providing a front hinged arch for encircling the scope;

providing a rear hinged arch for encircling the scope;

and wherein said front and rear hinged arches can be attached to a mounting rail and the axial length between said front and rear hinged arches is adjustable, and wherein said front and rear hinged arches are each fabricated from arcuate members hingeably connected generally along their top ends by a hinge pin, one of said arcuate members having a floor piece attached thereto, the floor piece abutting a stud connected with the opposite arcuate member, the floor piece and stud having cam faces allowing them to be attached to the mounting rail;

and wherein a through bore extends through the cam faces to allow said hinged arches to be fixably connected to the mounting rail by a screw;

providing a plurality of protector rods for connection with and extension between said hinged arches; and connecting said hinged arches with a PICATINNY RAIL of said gun with a screw.

13. A method as described in claim 12, further including threadably connecting an extension to at least one of said protector rods.

* * * * *